US008685521B2

(12) United States Patent
Yanagawase et al.

(10) Patent No.: US 8,685,521 B2
(45) Date of Patent: Apr. 1, 2014

(54) STITCHBONDED FABRIC

(75) Inventors: Takeshi Yanagawase, Otsu (JP); Takasaburo Isshiki, Otsu (JP)

(73) Assignee: Invista North America S.àr.l., Wilmington, DE (US)

( * ) Notice: Subject to any disclaimer, the term of this patent is extended or adjusted under 35 U.S.C. 154(b) by 792 days.

(21) Appl. No.: 10/546,351

(22) PCT Filed: Feb. 20, 2004

(86) PCT No.: PCT/US2004/005322

§ 371 (c)(1),
(2), (4) Date: Jul. 7, 2006

(87) PCT Pub. No.: WO2004/076733

PCT Pub. Date: Sep. 10, 2004

(65) Prior Publication Data

US 2007/0015427 A1 Jan. 18, 2007

(30) Foreign Application Priority Data

Feb. 24, 2003 (JP) ..... 2003-045307

(51) Int. Cl.
*B32B 3/06* (2006.01)
*B32B 7/08* (2006.01)

(52) U.S. Cl.
USPC ..... 428/102; 112/415; 112/438

(58) Field of Classification Search
USPC ..... 442/331, 309, 308, 319; 428/102; 112/416, 415, 413, 438, 429, 430
See application file for complete search history.

(56) References Cited

U.S. PATENT DOCUMENTS

| | | | | | |
|---|---|---|---|---|---|
| 3,018,272 | A | * | 1/1962 | Griffing et al. | 528/293 |
| 3,671,379 | A | * | 6/1972 | Evans | 428/362 |
| 4,704,321 | A | | 11/1987 | Zafiroglu | |
| 4,737,394 | A | | 4/1988 | Zafiroglu | |
| 4,773,238 | A | | 9/1988 | Zafiroglu | |
| 4,876,128 | A | | 10/1989 | Zafiroglu | |
| 4,879,169 | A | | 11/1989 | Zafiroglu | |
| 4,897,297 | A | | 1/1990 | Zafiroglu | |
| 4,998,421 | A | | 3/1991 | Zafiroglu | |
| 5,041,255 | A | | 8/1991 | Zafiroglu | |
| 5,203,186 | A | * | 4/1993 | Zafiroglu | 66/192 |
| 5,308,674 | A | * | 5/1994 | Zafiroglu | 428/102 |
| 5,310,590 | A | * | 5/1994 | Tochacek et al. | 428/102 |
| 5,543,004 | A | * | 8/1996 | Tochacek et al. | 156/93 |

(Continued)

FOREIGN PATENT DOCUMENTS

| | | |
|---|---|---|
| EP | 390579 | 11/1993 |
| EP | 476193 | 12/1994 |

(Continued)

OTHER PUBLICATIONS

M.L. Joseph, Introductory Textile Science, 1986, Holt, Rinehart, and Winston, 5th edition, pp. 195-197.*

*Primary Examiner* — Cheryl Juska
(74) *Attorney, Agent, or Firm* — Christina W. Geerlof

(57) ABSTRACT

The invention provides a stitchbonded nonwoven fabric comprising a nonwoven web, stitches of a first yarn, and stitches of a second yarn wherein the first yarn comprises polyester bicomponent fibers exhibiting latent crimp and comprising poly(ethylene terephthalate) and poly(trimethylene terephthalate). The invention further provides a process for making such stitch-bonded nonwoven fabric.

12 Claims, 2 Drawing Sheets

(56) References Cited

U.S. PATENT DOCUMENTS

| | | | | |
|---|---|---|---|---|
| 5,623,888 | A * | 4/1997 | Zafiroglu | 112/414 |
| 5,692,777 | A * | 12/1997 | Tochacek et al. | 280/743.1 |
| 5,826,905 | A * | 10/1998 | Tochacek et al. | 280/743.1 |
| 5,922,433 | A | 7/1999 | Scherbel | |
| 6,277,469 | B1 * | 8/2001 | Wildeman | 428/167 |
| 6,521,554 | B1 * | 2/2003 | Wildeman | 442/366 |
| 6,593,256 | B1 * | 7/2003 | Wildeman | 442/402 |
| 6,668,598 | B2 | 12/2003 | Miyake et al. | |
| 6,673,443 | B2 * | 1/2004 | Koyanagi et al. | 428/364 |
| 6,855,392 | B2 * | 2/2005 | Wildeman et al. | 428/88 |
| 6,982,118 | B2 * | 1/2006 | Koyanagi et al. | 428/364 |
| 2003/0134094 | A1 | 7/2003 | Zafiroglu et al. | |
| 2003/0162454 | A1 | 8/2003 | Huo | |
| 2004/0115388 | A1 * | 6/2004 | Wildeman et al. | 428/95 |
| 2004/0192142 | A1 * | 9/2004 | Zafiroglu et al. | 442/352 |

FOREIGN PATENT DOCUMENTS

| | | | |
|---|---|---|---|
| GB | 1421694 | | 1/1976 |
| GB | 2236771 | A * | 4/1991 |
| JP | 63105191 | | 5/1988 |
| JP | 04091266 | | 3/1992 |
| JP | 07197355 | | 8/1995 |
| JP | 2000256918 | | 9/2000 |
| JP | 2000336581 | | 12/2000 |

* cited by examiner

STITCHBONDED FABRIC

BACKGROUND OF THE INVENTION

1. Field of the Invention

The present invention relates to a stitchbonded nonwoven fabric, particularly such a fabric wherein the stitches of at least one yarn comprise a bicomponent polyester fiber of poly(ethylene terephthalate) and poly(trimethylene terephthalate), to a process for making such a fabric, and to artificial leather and articles of manufacture comprising such a fabric.

2. Technical Background

Stitchbonding is a technique in which a nonwoven fabric can be inserted between the sinker loops and needle loops of a warp knit fabric composed of two yarns. For example, the use of spandex in making stitchbonded nonwovens has been disclosed in U.S. Patents U.S. Pat. Nos. 4,704,321, 4,737,394, 4,773,238, 4,879,169, 4,897,297, 5,041,255, 4,876,128, 4,998,421, in European Patent EP476,193B1, and in their Japanese counterparts. However, when such nonwovens are impregnated with a polyurethane resin solution to make artificial leather, the solvent for the polyurethane resin can degrade the spandex, and manufacturing conditions and product control can become difficult.

Artificial leather having stretch characteristics has been disclosed in United States Published Application US2003/162454. Laminated natural leather has been disclosed in United States Patent U.S. Pat. No. 5,932,056 but can be relatively costly.

Bicomponent fibers have been used in knits and nonwovens, as disclosed in United States Patents U.S. Pat. Nos. 5,922,433 and 6,668,598, British Patent GB1,421,694, United States Published Application US2003/0134094, and Japanese Published Application JP2000-336581A. Although knits can be used as a base fabric for stretchable artificial leathers, such fabrics must be modified to restrain elongation of the fabric in the longitudinal direction during processing. Further, napping, sanding, or buffing the knit fabric or a resin-coated coarse woven fabric (sometimes called a "butter muslin") is required to improve adhesion and prepare the surface of the fabric before coating with a polyurethane.

There remains a need for a nonwoven fabric that does not require extra manufacturing steps to be suitable for use in manufactured articles including those comprising an artificial leather with stretch properties similar to those of natural leather.

SUMMARY OF THE INVENTION

The present invention provides a stitchbonded nonwoven fabric comprising a nonwoven web, stitches of a first yarn, and stitches of a second yarn wherein the first yarn comprises polyester bicomponent fibers exhibiting latent crimp and comprising poly(ethylene terephthalate) and poly(trimethylene terephthalate). The invention further provides such a fabric wherein the stitches are a warp knit construction, the bicomponent fibers exhibit developed crimp and have a configuration selected from the group consisting of side-by-side and eccentric sheath-core, and wherein the stitches of the first yarn exhibit an underlap of two to seven needle spaces.

The invention also provides a process for making a stitchbonded nonwoven fabric comprising the steps of a) providing a warp knitting machine having a first guide bar and a second guide bar, a precursor nonwoven fabric web, a first yarn comprising polyester bicomponent fibers having a cross-section configuration selected from the group consisting of side-by-side and eccentric sheath-core and comprising poly(ethylene terephthalate) and poly(trimethylene terephthalate), and a second yarn; b) feeding the first yarn through the first guide bar; c) feeding the second yarn through the second guide bar; d) feeding the precursor web to the knitting machine so that after knitting it is between sinker loops and needle loops of knit stitches; and e) knitting the first yarn and the second yarn through the precursor web by reciprocally shogging the first guide bar and the second guide bar, each over a plurality of needle spaces. An optional process step of f), heating the stitchbonded nonwoven fabric at a temperature and for a time sufficient to develop crimp in the polyester bicomponent fibers, is also provided.

In addition, the invention provides an artificial leather and an article of manufacture comprising the inventive fabric.

DETAILED DESCRIPTION OF THE INVENTION

Figure 1:
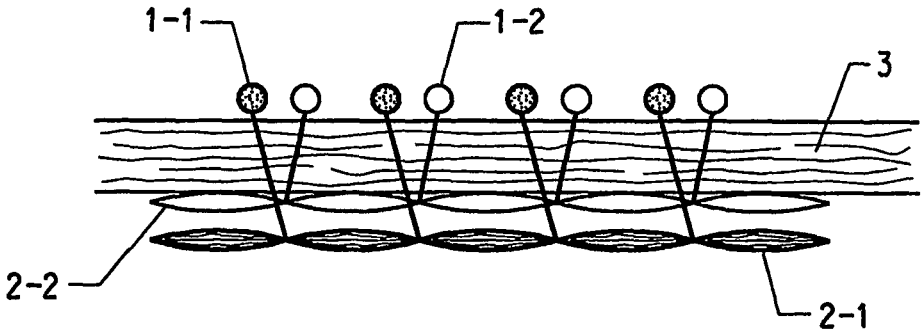
FIG. 1 is a cross-sectional schematic view of a stitchbonded fabric of the invention.

It has now been unexpectedly found that a stitchbonded nonwoven fabric, wherein at least one of the yarns stitched into the precursor nonwoven fabric comprises polyester bicomponent fibers, has highly desirable characteristics such as high stretch and, typically, good adhesion to polymeric coatings and excellent visual uniformity, both when uncoated and when coated. The bicomponent fibers exhibit latent crimp, which can be developed by exposure to heat after stitchbonding.

As used herein, "fiber" means a staple fiber and/or a continuous filament. "Yarn" means a plurality of fibers used as a unit; it is preferred that the yarns be of continuous filaments. "Bicomponent fiber" means a polyester staple fiber and/or a polyester continuous filament exhibiting latent crimp from which useful crimp can be developed, and comprising poly(ethylene terephthalate) as a first component and poly(trimethylene terephthalate) as a second component, typically in a weight ratio of about 70/30 to 30/70.

"Monocomponent fiber" means a staple fiber and/or a continuous filament comprising at least about 85 weight percent of one polymer or copolymer, for example selected from the group consisting of poly(ethylene terephthalate), poly(trimethylene terephthalate), poly(tetramethylene terephthalate), polypropylene, poly(hexamethylene adipamide), polycaprolactam, and copolymers thereof.

"Nonwoven fabric" and "nonwoven web" mean a textile structure of individual fibers, filaments, or threads that are directionally or randomly oriented and optionally bonded by friction, and/or cohesion and/or adhesion, as opposed to a regular pattern of mechanically inter-engaged fibers; i.e., it is not a woven or knitted fabric.

The stitchbonded nonwoven fabric of the invention comprises a nonwoven web, stitches of a first yarn exhibiting latent crimp and comprising a polyester bicomponent fiber comprising poly(ethylene terephthalate) and poly(trimethylene terephthalate), and stitches of a second yarn which can be the same as, or different from, the first yarn. The bicomponent fiber can exhibit developed crimp, typically after heat-treatment.

The stitchbonded nonwoven fabric can have a basis weight of about 10 to 150 g/m$^2$, and a transverse tear strength of about 18 to 22 Newtons.

When the fabric is to be used to make artificial leather, it is preferred that, on a surface of the fabric, the first yarn (comprising bicomponent fibers) be positioned outside the second yarn, that is, that the second yarn be between the first yarn and the precursor nonwoven web. The fabric can have a transverse stretch of about 10 to 50% (preferably about 40 to 50%) and a longitudinal stretch of about 0 to 10% (preferably about 0 to 7%).

The precursor nonwoven web can comprise fibers of poly (ethylene terephthalate), poly(trimethylene terephthalate), polypropylene, poly(paraphenylene terephthalamide), poly (metaphenylene isophthalamide), cellulose, plexifilamentary polyethylene, copolymers thereof, and the like. Examples of nonwoven fabric and web constructions include needlepunched, spunlaced, hydraulically needled, spunbonded, carded, air-laid, and wet-laid constructions of staple fibers and/or continuous filaments.

When the stitches of the yarns are of a warp knit construction, those of the first yarn can exhibit an underlap of two to seven needle spaces, typically a lap of 1-0/2-3 to 1-0/7-8, more typically a lap selected from the group consisting of 1-0/4-5, 1-0/5-6, 1-0/6-7 and 1-0/7-8. The stitches of the second yarn can exhibit a lap selected from the group consisting of 1-0/0-1 (sometimes called a "pillar stitch"), 1-2/1-0, 2-3/1-0 and 3-4/1-0, more typically a 1-2/1-0 lap.

One or both of the polyesters comprising the bicomponent fiber can be copolyesters, and "poly(ethylene terephthalate)" and "poly(trimethylene terephthalate)" include such copolyesters within their meanings. For example, a copoly(ethylene terephthalate) can be used in which the comonomer used to make the copolyester is selected from the group consisting of linear, cyclic, and branched aliphatic dicarboxylic acids having 4-12 carbon atoms (for example butanedioic acid, pentanedioic acid, hexanedioic acid, nonanedioic acid, decanedioic acid, dodecanedioic acid, and 1,4-cyclo-hexanedicarboxylic acid); aromatic dicarboxylic acids other than terephthalic acid and having 8-12 carbon atoms (for example isophthalic acid and 2,6-naphthalenedicarboxylic acid); linear, cyclic, and branched aliphatic diols having 3-8 carbon atoms (for example 1,3-propane diol, 1,2-propanediol, 1,4-butanediol, 1,5-pentanediol, 3-methyl-1,5-pentanediol, 2,2-dimethyl-1,3-propanediol, 2-methyl-1,3-propanediol, cyclohexanedimethanol, and 1,4-cyclohexanediol); aromatic diols such as hydroquinone and bisphenol A; hydroxyacids such as p-hydroxybenzoic acid and ϵ-caprolactone; and aliphatic and araliphatic ether glycols having 4-10 carbon atoms (for example, hydroquinone bis(2-hydroxyethyl) ether, or a poly (ethyleneether) glycol having a molecular weight below about 460, including diethyleneether glycol). The comonomer can be present to the extent that it does not compromise the benefits of the invention, for example at levels of up to about 20 mole percent, typically up to about 10 mole percent, based on total polymer ingredients. lsophthalic acid, pentanedioic acid, hexanedioic acid, 1,3-propane diol, and 1 ,4-butanediol are preferred comonomers.

The copolyester(s) can also be made with minor amounts of other comonomers, provided such comonomers do not have an adverse affect on the benefits of the invention. Such other comonomers include 5-sodium-sulfoisophthalic acid, the sodium salt of 3-(2-sulfoethl) hexanedioic acid, and dialkyl esters thereof, which can be incorporated at about 0.2-4 mole percent based on total polyester. For improved acid dyeability, the (co)polyester(s) can also be mixed with polymeric secondary amine additives, for example poly(6,6'-imino-bishexamethylene terephthalamide) and copolyarnides thereof with hexamethylenediamine, typically phosphoric acid and phosphorous acid salts thereof.

For high developed crimp, the bicomponent fiber can have a side-by-side or eccentric sheath-core cross-section configuration. There is no particular limitation on the outer cross-section of the bicomponent fiber, which can be round, oval, triangular, 'snowman', 'scalloped oval', and the like. A 'snowman' cross-section can be described as a side-by-side cross-section having a long axis, a short axis and at least two maxima in the length of the short axis when plotted against the long axis. A 'scalloped oval' cross-section has a plurality of longitudinal grooves in the surface thereof, which can improve the wicking properties of the polyester bicomponent.

The poly(ethylene terephthalate) and the poly(trimethylene terephthalate) in the bicomponent fiber can typically have different intrinsic viscosities. For example, the poly(ethylene terephthalate) can have an intrinsic viscosity of about 0.45 to 0.60 dl/g and the poly(trimethylene terephthalate) can have an intrinsic viscosity of about 1.0 to 1.20 dl/g, determined by dissolving 0.10 g of the polymer in 10 ml of o-chlorophenol, and measuring the viscosity at 25° C. using an Ostwald viscometer.

Individual polyester bicomponent fibers used in the present invention can have a titer of about 0.4 to 25 decitex per filament. A yarn made from such a fiber can have a total titer of about 20 to 1,000 decitex, typically about 44 to 156 decitex.

When the second yarn comprises polyester monocomponent fibers, the fibers can comprise a copolymer as described elsewhere herein when the polymer is poly(ethylene terephthalate), and with the further inclusion of ethylene glycol as an optional comonomer, when the polymer is poly(trimethylene terephthalate) or poly(tetramethylene terephthalate). When the second yarn comprises polyarnide monocomponent fibers, the fibers can comprise a copolymer in which the comonomer is terephthalic acid, isophthalic acid, adipic acid, sebacic acid, hexamethylenediamine, caprolactam, 2-methylpentamethylenediamine, 1,4-bis(aminomethyl)-cyclohexane, poly(2-methylpentamethyleneadipamide), and the like.

There is no particular limitation on the outer cross-section of the monocomponent fiber, which can be round, oval, triangular, scalloped oval or any other useful cross-section.

It is preferred that the second yarn, when it comprises a monocomponent fiber, be false-twisted so as to confer some stretch. The second yarn can have a total titer of about 56 to 330 decitex, typically about 44 to 156 decitex.

Any one, two, or all of the first yarn, second yarn, and nonwoven web fibers used to make the stitchbonded nonwoven of the present invention can also comprise conventional additives such as antistats, antioxidants such as hindered phenols, antimicrobials, flameproofing agents, dyestuffs and/or colored pigments, light stabilizers, finely divided silica or alumina, and delustrants such as titanium dioxide, provided they do not detract from the benefits of the invention.

Articles of manufacture comprising the stitchbonded nonwoven fabric of the invention include stretch medical dressings and sanitary panties. The fabric of the invention can also be used to make articles comprising artificial leather in which the base fabric of the leather is the fabric of the invention. Such articles include footwear (for example shoes, boots, slippers), home and automotive upholstery, outerwear (for example jackets, coats, pants), accessories (for example handbags, hats, belts), and luggage. The stretch characteristics of artificial leather should approximate those of natural leather, which typically has higher stretch in a first direction than in a second direction approximately perpendicular to the first direction. For example, natural leather for footwear is ordinarily cut "tight heel to toe" so that the lines of tightness (low stretch) run from the heel toward the toe. This provides footwear with longitudinal stability while allowing lateral flex and stretch for durability and comfort.

The inventive stitchbonded nonwoven fabric can have low stretch in the longitudinal direction and relatively high stretch in the transverse direction, so that when coated with a polyurethane, it mimics the mechanical properties of natural leather. Further, the small crimps of the bicomponent fiber on the sinker loop surface of the fabric allow the traditional napping step to be omitted without deleterious effect on coating adhesion, reducing production costs.

There is no particular limitation on the polymer used to coat the stitchbonded nonwoven fabric of the invention or on the method of coating. The polymer can be a polyurethane (preferred), poly(vinyl chloride), poly(vinyl butyral), polyacrylic, poly(amino acid), or silicone, and it can be applied as an aqueous emulsion (dispersion) or as a solution in an organic solvent. Optionally, pigments, ultraviolet absorbers, flame retardants, foaming agents, softeners, dyes, and/or antioxidants can be added to the solutions or dispersions of the polymer(s).

Useful polyurethanes for coating or impregnating can be obtained by reacting a polymeric glycol such as a polyester glycol, a polyether glycol, and/or a polycarbonate glycol, with a diisocyanate and then chain extending the resulting "capped glycol" with at least one diamine, alcoholamine, or diol.

Examples of polyester glycols include poly(neopentylene adipate) glycol, poly(ethylene-co-tetramethylene adipate) glycol, poly(2,2-dimethylpropylene dodecanedioate) glycol, and poly(2,5-diethylpentamethylene adipate) glycol. Examples of polyether glycols include poly(tetramethylene ether) glycol, poly(trimethylene ether) glycol, and poly(tetramethylene-co-2-methyltetramethylene ether) glycol. Examples of polycarbonate glycols include those derived from 1,6-hexanediol, 1,5-pentanediol, neopentyl glycol, and 3-methyl-1,5-pentanediol. The polymeric glycol can have a number-average molecular weight of about 500 to 3,500 (typically about 800-2500).

The glycol can be reacted with a diisocyanate selected from the group consisting of aromatic, alicyclic, and aliphatic diisocyanates and mixtures thereof. Examples include 4,4'-diphenylmethanediisocyanate, 2,4'-diphenylmethanediisocyanate, 4-methyl-1,3-phenylene diisocyanate, 2,2-bis(4-isocyanatophenyl)propane, 4,4'-methylene-bis (cyclohexylisocyanate), 4,4'-dicyclohexylmethane diisocyanate, 3,3,5-trimethyl-5-methylenecyclohexyl diisocyanate, 1,6-hexamethylene diisocyanate, and mixtures thereof.

The resulting 'capped glycol', optionally dissolved in a suitable solvent, can be reacted ("chain extended") with at least one low-molecular weight compound having two or more active hydrogen atoms and a molecular weight of not more than about 300. Examples include ethylene glycol (preferred), propylene glycol, 1,3-trimethylene diol, 1,4-butanediol, 3-methyl-1,5-pentanediol, 1,6-hexanediol, diethyleneether glycol, dipropyleneether glycol, ethylenediamine, 2-methyl-1,5-pentanediamine, diethylenetriamine, 1,3-diaminocyclohexane, 1,4-diaminocyclohexane, 1,3-diaminopentane, 1-amino-3,3,5-trimethyl-5-aminomethylcyclohexane, methylene bis-aniline, piperazine, phenylenediamine, adipic hydrazide, and isophthalic hydrazide. When a diol chain extender is used, a catalyst can be added, for example an organo-tin compound, an organo-titanium compound, or a tertiary amine. If a plurality of polymeric diols and/or diisocyanates is used, they can be separately reacted to produce a number of prepolymers which can then be mixed and chain extended, or one prepolymer can be prepared with the mixed ingredients and then chain extended.

Alternatively, a 'one-shot' method can be used, in which all the starting materials are mixed together and reacted.

The nonwoven can be coated or impregnated with the polyurethane solution or dispersion by immersion, horizontal coating, squeezing between nip rolls, transfer coating, or the like.

The impregnated stitchbonded nonwoven can then be dried to remove the solvent, or it can be immersed in water or in an aqueous organic solvent solution to coagulate the polyurethane. For example, the nonwoven can be impregnated with a solution having a polyurethane concentration of 10 wt % to 60 wt %, and then contacted with a solution of about 60/40 to 0/100 dimethylformamide/water at a temperature of about 20° C. to 700° C. The coagulation can be carried out by sequential immersion in a plurality of aqueous solutions which differ in their dimethylformamide/water ratios and temperatures.

The solvent in the polyurethane solution and in the aqueous mixture can be N,N'-dimethylformamide, dimethylsulphoxide, N,N'-dimethylacetamide, N-methylpyrrolidone, or the like. A coagulation regulator can also be used, for example a higher alcohol or a (cationic) surfactant, for example didodecyldimethylammonium, dodecyltrimethylammonium and tetradecylpyridinium chlorides or bromides, or the like, for example at a concentration of 0.5 to 5 grams per liter of solvent.

In the process of the invention, a precursor nonwoven fabric web, a first yarn, and a second yarn are fed to a knitting machine, for example a warp knitting machine having two or more (at least a first and a second) guide bars, such as a Liba RACOP 2K-V or a Karl Mayer RS2V. The precursor nonwoven web can be as described elsewhere herein. The first yarn has a cross-section selected from the group consisting of side-by-side and eccentric sheath-core, comprises a polyester bicomponent fiber comprising poly(ethylene terephthalate) and poly(trimethylene terephthalate) and is fed through the first guide bar, which is preferably the front guide bar, of the knitting machine. When the first yarn is fed through the front guide bar, it becomes positioned, in the stitchbonded fabric, outside the second yarn, that is, away from a surface of the precursor nonwoven web. The second yarn can be the same as the first yarn or can comprise a monocomponent fiber as described elsewhere herein, for example a false-twist textured poly(ethylene terephthalate) fiber, and is fed through the second guide bar, which is preferably the back guide bar, of the knitting machine. When the second yarn is fed through the back guide bar, it becomes positioned, in the stitchbonded fabric, between a surface of the precursor nonwoven web and the first yarn. The precursor web is fed to the knitting machine so that after knitting it is between sinker loops and needle loops of the knit stitches. The first yarn and the second yarn are knit through the precursor web by reciprocally shogging the first guide bar and the second guide bar, each over a plurality of needle spaces.

For improved appearance and adhesion to a polymeric coating, the movement of the first (for example, front) guide bar can be selected. The front guide bar can be shogged over a plurality (preferably three to seven) of needle spaces; a 1-0/2-3 to 1-0/7-8 lap is more preferred, and a front bar stitch selected from the group consisting of 1-0/4-5, 1-0/5-6, 1-0/

6-7 and 1-0/7-8 is most preferred. The back guide bar can be shogged over a plurality of needle spaces in opposition to the front bar, for example with a lap of 1-0/0-1 or a lap selected from the group consisting of 1-2/1-0, 2-3/1 -0 and 3-4/1-0. A 1-2/1-0 lap is preferred.

The process of the invention can further comprise a step of exposing the stitchbonded nonwoven fabric to sufficient heat for a sufficient time to develop high crimp levels in the bicomponent fiber yarn. The heat can be dry or wet heat. For example, dry heat treatment (in which neither water nor water vapor is deliberately added to the heat-treating environment) can be carried out at about 160 to 180° C. for 20 to 60 seconds. Wet heat treatment, for example with steam or in a dyebath, can be carried out at about 120 to 145° C. for about 3 to 40 seconds; longer times, for example as can be experienced in a dyebath, are not detrimental to crimp development.

Examples are given herein by way of illustration, but are not intended to limit the invention. The nonwoven used was a polyester spunbonded fabric Type 6201, made by Toyobo Co., Ltd., having a basis weight of 20 g/m$^2$. The polyester bicomponent used was 'PY92', a 56 decitex/24 filament unentangled bicomponent of poly(ethylene terephthalate) and poly(trimethylene terephthalate) manufactured by Toray Industries; during stitchbonding, its crimp was latent and was not fully developed until the stitchbonded nonwoven was heat-treated. The poly(ethylene terephthalate) filament used was "Wooly Tetron", an 83 dtex, 36 filament false-twist textured yarn made by Toray Industries, Inc.; it is indicated in the Tables as "WT".

The mechanical characteristics of the fabrics in the Examples were determined by the following Japanese Institute of Standards methods:

| | |
|---|---|
| Strength at break: | JIS L-1018 (strip method) |
| Elongation at break: | JIS L-1018 (strip method) |
| Percent recovery from extension: | JIS L-1096 (A) |
| Tear strength: | JIS L-6772 |
| Percent stretch: | JIS L-1018 (constant load method: 22.1 Newtons) |
| Burst strength: | JIS L-1018A |

EXAMPLES

Example 1

A greige stitchbonded nonwoven fabric was made under the knitting conditions shown in Table 1 using a bicomponent yarn of poly(ethylene terephthalate) and poly(trimethylene terephthalate) on the front guide bar, a false-twist textured yarn primarily of poly(ethylene terephthalate) on the back guide bar, and a polyester spunbonded nonwoven.

TABLE 1

Stitchbonded Nonwoven Fabric Knitting Conditions.

| Knitting machine | Liba RACOP2: 12 gauge, 130 inch | | |
|---|---|---|---|
| Guide bars | front bar | back bar | nonwoven fabric feeder |
| Material | PY92 | WT | Toyobo Type 6201 |
| Threading | full set | full set | |
| Construction | 1-0/4-5 | 1-2/1-0 | |
| Runner length (cm/rack) | 550 | 260 | 53 |
| Courses on machine (courses/inch) | 23.7 | | |

The front bar stitch is sometimes called a 'velvet' stitch, and the back bar stitch is sometimes called a 'tricot' stitch. The greige fabric was then subjected to the conditions shown in Table 2 to give a preferred embodiment of the stitchbonded fabric of the invention, in which, on a surface of the stitchbonded nonwoven, the polyester bicomponent yarn is positioned outside the poly(ethylene terephthalate) monocomponent yarn, that is, the monocomponent yarn is between the bicomponent yarn and the precursor nonwoven web.

TABLE 2

Fabric Treatment Conditions

| Operation | Treatment apparatus | Treatment conditions |
|---|---|---|
| Greige fabric set | tenter frame | 150° C., 20 m/min |
| Dyeing | jet dyeing machine | 125° C., 40 min, disperse dye (gray) |
| Finish fabric set | tenter frame | 140° C., 20 m/min |

The heated part of the tenter frame was 21 meters long, and the time at those temperatures was 57 seconds.

Figure 2A:
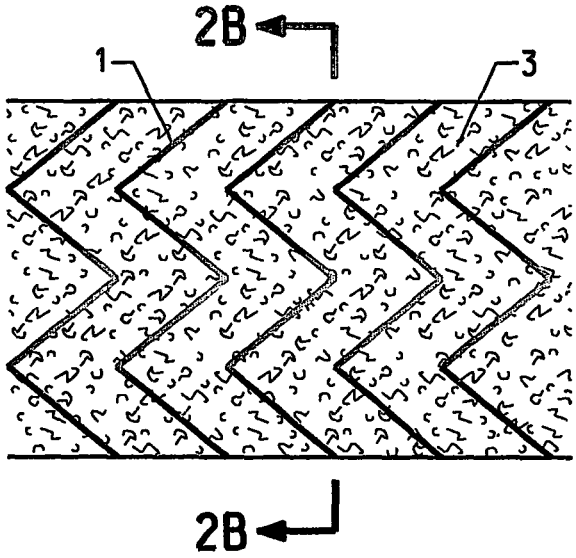
FIG. 2A is a simplified plan view of a stitchbonded fabric of the invention.
Figure 2B:
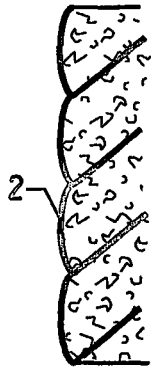
FIG. 2B is a simplified cross-sectional view of a stitchbonded fabric of the invention.
Figure 3:
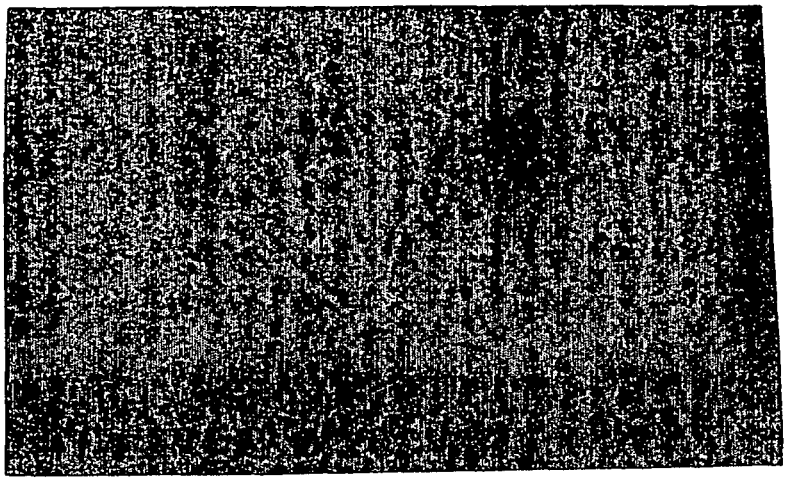
FIG. 3 is a photomicrograph of a preferred fabric of the invention.

FIG. 1 shows a cross-sectional schematic view of the fabric of Example 1. FIG. 2A is a simplified plan view of the fabric in Example 1, and FIG. 2B is a simplified cross-sectional view of the same fabric. In FIGS. 1 and 2, 1 indicates a sinker loop, and 2 indicates a knit loop. 1-1 indicates a front guide bar sinker loop, 1-2 indicates a back guide bar sinker loop, 2-1 indicates a front guide bar needle loop, in which the yarn is positioned outside back guide bar needle loop 2-2, and 3 indicates the nonwoven fabric. FIG. 3 is a photomicrograph, at 1.5× magnification, of the heat-treated fabric made in Example 1.

Comparison Example 1

A greige stitchbonded nonwoven fabric was made under the knitting conditions shown in Table 3 using a polyester false-twist textured yarn primarily of poly(ethylene terephthalate) on both the front and back guide bars and a polyester spunbonded nonwoven.

TABLE 3

Comparison Nonwoven Fabric Knitting Conditions.

| Knitting machine | Liba RACOP2: 12 gauge, 130 inch | | |
|---|---|---|---|
| Guide bars | front bar | back bar | nonwoven fabric feeder |
| Material | WT | WT | Toyobo Type 6201 |
| Threading | full set | full set | |
| Construction | 0-1/1-0 | 1-0/4-5 | |
| Runner length (cm/rack) | 200 | 570 | 57 |
| Courses on machine(courses/inch) | 21.8 | | |

Figure 4:
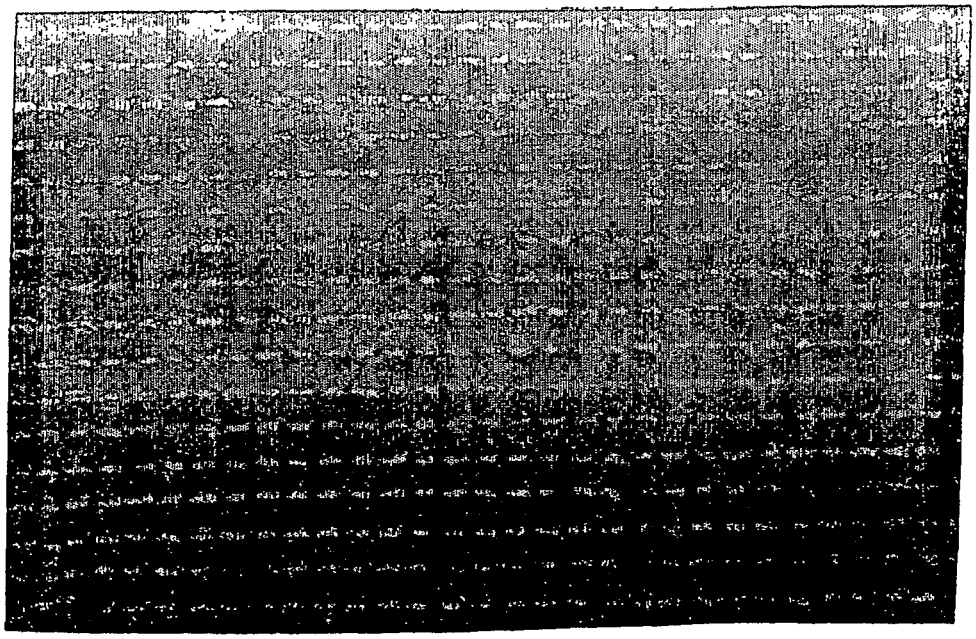
FIG. 4 is a photomicrograph of a fabric not of the invention.

The front bar has knit what is sometimes called a 'pillar' stitch, which is believed to result in somewhat higher longitudinal stretch. The back bar is sometimes called a 'velvet' stitch. The fabric was also treated under the conditions of Table 2 to give a finished fabric. FIG. 4 is a photomicrograph, at 1.5× magnification, of the heat-treated fabric made in Comparison Example 1; undesirable streaks are clearly visible.

The heat-treated, finished stitchbonded fabrics obtained in Example 1 and in Comparison Example 1 were evaluated with regard both to their mechanical properties and their appearance. The results are reported in Table 4, wherein "transverse" refers to the cross-direction (weft) of the stitchbonded fabrics, and "longitudinal" refers to the machine-direction (wale) of the stitchbonded fabrics. An appearance rating of "excellent" was assigned when there were no streaks on the surface, and a rating of "poor" was assigned when streaks were evident on the surface.

The heat-treated fabrics were then impregnated with polyurethane using a solution of 60 parts by weight of SANPRENE LQ-620 and 40 parts by weight of SANPRENE LQ-660 in 100 parts by weight of dimethylformamide. Both polymers are polyesterurethanes available from Sanyo Chemical Industries. Ltd. The viscosity of the solution was 8000 mPascal-seconds. It was applied by hand to the sinker loop surface of the heat-treated stitchbonded nonwoven fabrics using a doctor knife (a manual form of horizontal gap coating) at 1000 grams of solution per square meter of fabric. The solvent was removed by coagulation at 20° C. with a dimethylformamide/water mixture (13/87 by weight), then soaking in 50° C. water for 20 minutes, and finally drying at 120° C.

The appearance of the artificial leathers so obtained is also reported in Table 4. An appearance rating of "excellent" was assigned when the polyurethane-coated fabric had no loops or streaks remaining on the surface, and a rating of "poor" was assigned when loops or streaks remained on the surface.

TABLE 4

Properties of stitchbonded nonwoven fabrics and appearance of polyurethane-coated fabrics

| | | | Example 1 | Comp. Ex. 1 |
|---|---|---|---|---|
| Stitchbonded fabric | Course density (courses/inch) | | 24.0 | 23.0 |
| | Welt density (welts/inch) | | 23.0 | 22.0 |
| | Basis weight ($g/m^2$) | | 125 | 114 |
| | Strength at break (Newtons) | longitudinal | 385 | 374 |
| | | transverse | 265 | 272 |
| | Elongation at break (%) | longitudinal | 30.5 | 33.3 |
| | | transverse | 152 | 142 |
| | Recovery from extension (%) | longitudinal | 95 | 93 |
| | | transverse | 94 | 92 |
| | Tear strength (Newtons) | longitudinal | 15.8 | 16.8 |
| | | transverse | 18.3 | 17.5 |
| | Stretch (%) | longitudinal | 6.5 | 8.0 |
| | | transverse | 45.3 | 36.3 |
| | Burst strength (Newtons/$m^2$) | | 6.84 | 6.22 |
| | Appearance | | excellent | poor |
| Coated fabric | Appearance | | excellent | poor |

In the stitchbonded fabric of Example 1, long sinker loops formed by the front guide bar emerged on the surface of the greige fabric, giving an appearance suitable for a better adhering, more uniform polyurethane coating than in Comparison Example 1, even without an additional napping step.

In the stitchbonded fabric of Comparison Example 1, sinker loops chain knitted by the front guide bar appeared on the surface of long sinker loops formed by the back guide bar and caused streaks on the surface of the fabric which were evident even after the application of a thin coat of polyurethane resin.

Attempts to make a similar stitchbonded nonwoven using spandex were abandoned when it was observed that the transverse tear strength of the resulting fabrics was unacceptably low (less than 15 Newtons) for artificial leather use.

What is claimed is:

1. A stitchbonded nonwoven fabric comprising a nonwoven web, stitches of a first yarn, and stitches of a second yarn wherein the first yarn comprises polyester bicomponent fibers exhibiting latent crimp and comprising poly(ethylene terephthalate) and poly(trimethylene terephthalate), and wherein the second yarn comprises a monocomponent fiber that is false-twisted to confer stretch thereto.

2. The fabric of claim 1 wherein the stitches are a warp knit construction, the bicomponent fibers exhibit developed crimp and have a configuration selected from the group consisting of side-by-side and eccentric sheath-core, and wherein the stitches of the first yarn exhibit an underlap of two to seven needle spaces.

3. The fabric of claim 2 having a transverse stretch of about 10% to 50% and a longitudinal stretch of about 0 to 10%.

4. The fabric of claim 3 further comprising a polymer coating.

5. The fabric of claim 2 wherein the stitches of the first yarn exhibit a lap selected from the group consisting of 1-0/4-5, 1-0/5-6, 1-0/6-7 and 1-0/7-8, and the second yarn comprises a monocomponent fiber yarn comprising a polymer selected from the group consisting of poly(ethylene terephthalate), poly(trimethylene terephthalate), poly(tetramethylene terephthalate), poly(hexamethylene adipamide), polycaprolactam, and copolymers thereof, and the stitches of the second yarn exhibit an underlap of a plurality of needle spaces.

6. The fabric of claim 2 having a transverse tear strength of about 18-22 Newtons, a transverse stretch of about 40 to 50%, and a longitudinal 30 stretch of about 0 to 7%, wherein the nonwoven web comprises fibers of poly(ethylene terephthalate), the stitchbonded nonwoven fabric has a basis weight of about 10 to 150 g/m2, and the stitches of the second yarn exhibit a lap selected from the group consisting of 1-2/1-0, 1-0/0-1, 2-3/1-0, and 3-4/1-0.

7. The stitchbonded nonwoven fabric of claim 1, wherein the nonwoven web has a basis weight of about 10 to 150 g/m2 and a transverse tear strength of about 18 to 22 Newtons.

8. An article of manufacturer comprising the fabric of claim 2.

9. A process for making a stitchbonded nonwoven fabric comprising the steps of:

a) providing a warp knitting machine having a first guide bar and a second guide bar, a precursor nonwoven fabric web, a first yarn comprising polyester bicomponent fibers having a cross-section configuration selected from the group consisting of side-by-side and eccentric sheath-core and comprising poly(ethylene terephthalate) and poly(trimethylene terephthalate), and a second yarn comprising a monocomponent fiber that is false-twisted to confer stretch thereto;

b) feeding the first yarn through the first guide bar;

c) feeding the second yarn through the second guide bar;

d) feeding the precursor web to the knitting machine so that after knitting it is between sinker loops and needle loops of knit stitches; and e) knitting the first yarn and the second yarn through the precursor web by reciprocally shogging the first guide bar and the second guide bar, each over a plurality of needle spaces.

10. The process of claim 9 further comprising a step of f) heating the stitchbonded nonwoven fabric at a temperature and for a time sufficient to develop crimp in the polyester bicomponent fibers.

11. The process of claim 10 wherein the first guide bar is a front guide bar, the second guide bar is a back guide bar, and the first guide bar is reciprocally shogged over three to seven needle spaces.

12. The process of claim 9 wherein the first guide bar knits a lap selected from the group consisting of 1-0/4-5, 1-0/5-6, 1-0/6-7, and 1-0/7-8, the second guide bar knits a lap selected from the group consisting of 1-2/1-0, 1-0/0-1, 2-3/1-0 and 3-4/1-0, and the second yarn comprises monocomponent fibers selected from the group consisting of poly(ethylene terephthalate), poly(trimethylene terephthalate), polypropylene, poly(hexamethylene adipamide), polycaprolactam, and copolymers thereof.

* * * * *